US011833383B2

(12) United States Patent
Duong et al.

(10) Patent No.: US 11,833,383 B2
(45) **Date of Patent: *Dec. 5, 2023**

(54) PILATES REFORMER

(71) Applicant: Core Health & Fitness, LLC, Vancouver, WA (US)

(72) Inventors: Ken Duong, Stanton, CA (US); Kevin Corbalis, Tustin, CA (US)

(73) Assignee: Core Health and Fitness, LLC., Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/963,160

(22) Filed: Oct. 10, 2022

(65) Prior Publication Data

US 2023/0030924 A1 Feb. 2, 2023

Related U.S. Application Data

(63) Continuation of application No. 16/601,370, filed on Oct. 14, 2019, now Pat. No. 11,465,007.

(51) Int. Cl.

| | |
|---|---|
| ***A63B 21/02*** | (2006.01) |
| ***A63B 21/00*** | (2006.01) |
| ***A63B 22/00*** | (2006.01) |

(52) U.S. Cl.

CPC ..... *A63B 21/023* (2013.01); *A63B 21/154* (2013.01); *A63B 21/4035* (2015.10); (Continued)

(58) Field of Classification Search

CPC ..... A63B 2209/00; A63B 22/0089; A63B 22/0087; A63B 22/20; A63B 22/201; A63B 22/203; A63B 22/205; A63B 22/208; A63B 21/00069; A63B 21/4035; A63B 21/154; A63B 21/023; A63B 2225/09; A63B 2208/0204; A63B 2208/0233; A63B 2208/0252; A63B 1/00; A63B 1/05; A63B 23/1218

(Continued)

(56) References Cited

U.S. PATENT DOCUMENTS 1,750,549 A * 3/1930 Thomson ..... A63B 22/0087 482/130
3,658,327 A * 4/1972 Thiede ..... A63B 21/0628 482/133

(Continued)

*Primary Examiner* — Loan B Jimenez
*Assistant Examiner* — Thao N Do
(74) *Attorney, Agent, or Firm* — FOLEY & LARDNER LLP

(57) ABSTRACT

An exercise machine that includes an elongated frame having a head end and a foot end, and a moveable carriage slidably coupled to the frame and moveable between the head end and the foot end, the moveable carriage having a spring bracket coupled to an underside of the moveable carriage. The exercise machine also includes a spring support rod slideably coupled with the frame and disposed adjacent the foot end, and selectively positionable with reference to the foot end by a handle that extends from an interior area of the frame to an exterior area of the frame. The exercise machine also includes at least one resistive member coupled at a first end with the spring support rod and at a second end with the spring bracket, and configured to bias the moveable carriage towards the foot end of the frame.

20 Claims, 9 Drawing Sheets

(52) U.S. Cl.
CPC .. *A63B 22/0087* (2013.01); *A63B 2208/0204* (2013.01); *A63B 2208/0233* (2013.01); *A63B 2208/0252* (2013.01); *A63B 2225/09* (2013.01)

(58) Field of Classification Search
USPC ..... 482/142
See application file for complete search history.

(56) References Cited

U.S. PATENT DOCUMENTS 5,125,648 A 6/1992 Olschansky et al.
5,681,249 A * 10/1997 Endelman ..... A63B 21/154 482/133
6,042,523 A * 3/2000 Graham ..... A63B 22/203 482/79
6,120,425 A 9/2000 Endelman
6,186,929 B1 * 2/2001 Endelman ..... A63B 21/154 482/121
6,371,895 B1 * 4/2002 Endelman ..... A63B 22/0087 482/96
7,803,095 B1 * 9/2010 LaGree ..... A63B 22/0089 482/121
7,967,736 B2 * 6/2011 D'Silva ..... A63B 22/001 482/121
10,695,645 B1 * 6/2020 Lagree ..... A63B 21/4045
10,744,370 B1 * 8/2020 Lagree ..... A63B 21/4034
11,065,495 B1 * 7/2021 Savarino ..... A63B 21/023
11,465,007 B2 * 10/2022 Duong ..... A63B 22/0087
2001/0056011 A1 * 12/2001 Endelman ..... A63B 22/0087 482/121
2002/0058573 A1 * 5/2002 Endelman ..... A63B 21/055 482/142
2003/0032534 A1 * 2/2003 McAfee, Jr. ..... A63B 21/023 482/133
2003/0119635 A1 * 6/2003 Arbuckle ..... A63B 23/0405 482/142
2003/0119636 A1 * 6/2003 Endelman ..... A63B 21/023 482/142
2005/0085357 A1 * 4/2005 Endelman ..... A63B 22/0087 482/130
2005/0113227 A1 * 5/2005 Endelman ..... A63B 22/0007 482/130
2006/0046914 A1 * 3/2006 Endelman ..... A63B 23/03525 482/148
2009/0118108 A1 * 5/2009 Uygan ..... A63B 22/0087 482/135
2010/0279834 A1 * 11/2010 Rooks ..... A63B 22/0087 482/142
2011/0183822 A1 * 7/2011 Merrithew ..... A63B 22/203 482/121
2012/0178602 A1 * 7/2012 Rooks ..... A63B 21/022 482/142
2012/0202661 A1 * 8/2012 Jordan ..... A63B 21/0428 482/142
2012/0283078 A1 * 11/2012 Solow ..... A63B 23/02 482/130
2012/0283079 A1 * 11/2012 Solow ..... A63B 21/00065 482/142
2013/0017935 A1 * 1/2013 Endelman ..... A63B 21/154 482/131
2014/0187396 A1 * 7/2014 Endelman ..... A63B 21/4035 482/142
2014/0309087 A1 * 10/2014 Uygan ..... A63B 21/156 482/93
2015/0065318 A1 * 3/2015 Lagree ..... A63B 22/203 482/130
2015/0119213 A1 * 4/2015 Savarino ..... A63B 21/02 482/142
2015/0297935 A1 * 10/2015 Merrithew ..... A63B 22/0089 482/92
2015/0343258 A1 * 12/2015 Masterson ..... A63B 21/0428 482/123
2015/0360113 A1 * 12/2015 Lagree ..... A63B 21/00061 482/121
2018/0142982 A1 * 5/2018 Schwendemann ..... F41A 33/00
2018/0169464 A1 * 6/2018 Janowski ..... A63B 21/153
2019/0088160 A1 * 3/2019 Liu ..... G09B 19/0015
2019/0308058 A1 * 10/2019 Endelman ..... A63B 21/023
2021/0106864 A1 * 4/2021 Duong ..... A63B 21/00069

* cited by examiner

PILATES REFORMER

CROSS-REFERENCE TO RELATED APPLICATIONS

This application is a continuation of U.S. application Ser. No. 16/301,370, filed Oct. 14, 2019, which is hereby incorporated by reference in its entirety.

FIELD

This disclosure relates generally to exercise equipment, and more particularly to equipment having a moveable carriage which is moved against a resistive force including pilates reformers.

BACKGROUND

Traditional pilates reformers are rectangular and shape and typically made of wood, although metal frames are also used. Two parallel rails extend along the interior of the long sides of the rectangle and support a wheeled carriage. The carriage supports the body of a user, who typically sits, lies, or stands on the carriage. Springs or other resistive members bias the carriage and oppose the movement of the user. The user can push against a foot bar or use a rope and pulley system to move the carriage. The springs or other resistive members attach at one end to the carriage and at a second end to a spring bar rod. Common pilates reformers have a positionable spring bar rod, with reference to a foot bar or foot support. However, positioning the spring bar rod often requires a trainer to reach between the legs of the user to the interior of the frame. This can cause some discomfort for the user and the trainer.

SUMMARY

Disclosed herein is a pilates reformer that includes an elongated frame having a head end and a foot end spaced apart by a first side beam and a second side beam, where each of the first side beam and the second side beam comprises an interior surface and an exterior surface, and where the interior surface of the first side beam faces the interior surface of the second side beam. The pilates reformer also includes a first elongated rail coupled to the interior surface of the first side beam and extending from the head end to the foot end and having a spring positioning rod disposed within the first elongated rail and an elongated rail opening disposed adjacent a foot end of the first elongated rail, where the elongated rail opening comprises a plurality of positioning notches. The pilates reformer also includes a second elongated rail coupled to the interior surface of the second side beam and extending from the head end to the foot end and having a spring positioning rod disposed within the second elongated rail and an elongated rail opening disposed adjacent a foot end of the first elongated rail, where the elongated rail opening comprises a plurality of positioning notches. The pilates reformer also includes a first support rod carriage slidably coupled to the spring positioning rod of the first elongated rail, the first support rod carriage having a spring support rod socket and a pivotable lock plate for selectively engaging one of the plurality of positioning notches of the first elongated rail. The pilates reformer also includes a second support rod carriage slidably coupled to the spring positioning rod of the second elongated rail, the second support rod carriage having a spring support rod socket and a pivotable lock plate for selectively engaging one of the plurality of positioning notches of the second elongated rail. The pilates reformer also includes a handle operatively coupled to the pivotable lock plate of the first support rod carriage, where the handle extends outward laterally to an area that is external to the frame. The preceding subject matter of this paragraph characterizes example 1 of the present disclosure.

The pilates reformer also includes a handle plate having a first end and a second end, where the first end of the handle plate is operatively coupled to the pivotable lock plate of the first support rod carriage and the second end of the handle plate is operatively coupled to the pivotable lock plate of the second support rod carriage. The preceding subject matter of this paragraph characterizes example 2 of the present disclosure, wherein example 2 also includes the subject matter according to example 1, above.

The pilates reformer also includes a spring support rod having a first end and a second end, where the first end of the spring support rod is coupled with the spring support rod socket of the first support rod carriage and the second end of the spring support rod is coupled with the spring support rod socket of the second support rod carriage. The preceding subject matter of this paragraph characterizes example 3 of the present disclosure, wherein example 3 also includes the subject matter according to examples 1 and 2, above.

The spring support rod, in certain examples, further comprises a plurality of hooks, where each of the plurality of hooks is configured to couple with a first end of a biasing device. The preceding subject matter of this paragraph characterizes example 4 of the present disclosure, wherein example 4 also includes the subject matter according to examples 1-3, above.

The pilates reformer, in certain examples, also includes a moveable carriage. The moveable carriage is slideably coupled with the first elongated rail and the second elongated rail and moveable between the head end of the elongated frame and the foot end of the elongated frame. The preceding subject matter of this paragraph characterizes example 5 of the present disclosure, wherein example 5 also includes the subject matter according to example 4, above.

The pilates reformer also includes, in certain examples, a spring bracket coupled to an underside of the moveable carriage, the spring bracket having a plurality of hooks, where each of the plurality of hooks is configured to couple with a second end of the biasing device, and where the biasing device biases the moveable carriage towards the foot end of the elongated frame. The preceding subject matter of this paragraph characterizes example 6 of the present disclosure, wherein example 6 also includes the subject matter of example 5, above.

The pilates reformer also includes, in certain examples, a bump stop configured to engage the moveable carriage. The preceding subject matter of this paragraph characterizes example 7 of the present disclosure, wherein example 7 also includes the subject matter according to example 6, above.

The pilates reformer includes, in certain examples, a locking pin extending outward from the pivotable lock plate and configured to engage one of the plurality of positioning notches, and where a lifting force applied to the handle causes the locking pin to disengage the one of the plurality of positioning notches. The preceding subject matter of this paragraph characterizes example 8 of the present disclosure, wherein example 8 also includes the subject matter according to examples 1-7, above.

The handle, in certain examples, extends outward under the first side beam through an opening formed by the first side beam, a pair of legs of the elongated frame, and a floor.

The preceding subject matter of this paragraph characterizes example 9 of the present disclosure, wherein example 9 also includes the subject matter according to examples 1-8, above.

Additionally disclosed herein is a support rod carriage. The support rod carriage includes, in certain examples, a ball bearing collar configured to slideably couple with a spring positioning rod, a rod socket configured to receive an end of a spring support rod, a pivotable lock plate having a locking pin extending therefrom in lateral direction with reference to an elongated frame, and a handle operatively coupled with the pivotable lock plate, where the handle extends from the pivotable lock plate in the lateral direction. The preceding subject matter of this paragraph characterizes example 10 of the present disclosure.

In certain examples, the support rod carriage comprises a first support rod carriage, and further comprises a second support rod carriage. The preceding subject matter of this paragraph characterizes example 11 of the present disclosure, wherein example 11 also includes the subject matter according to example 10, above.

The support rod carriage, in certain examples, also includes a handle plate coupled at a first end with the pivotable lock plate of the first support rod carriage, and coupled at a second end with a pivotable lock plate of the second support rod carriage. The preceding subject matter of this paragraph characterizes example 12 of the present disclosure, wherein example 12 also includes the subject matter according to example 11, above.

The support rod, in certain examples, comprises a first support rod disposed within a first tubular rail, and further comprises a second support rod disposed within a second tubular rail. The preceding subject matter of this paragraph characterizes example 13 of the present disclosure, wherein example 13 also includes the subject matter according to examples 10-12, above.

In certain examples, each of the first tubular rail and the second tubular rail comprise an elongated opening comprising a plurality of positioning notches. The preceding subject matter of this paragraph characterizes example 14 of the present disclosure, wherein example 14 also includes the subject matter according to example 13, above.

In certain examples, the locking pin of the first support rod carriage is selectively engageable with one of the plurality of positioning notches of the first tubular rail, and the locking pin of the second support rod carriage is selectively engageable with one of the plurality of positioning notches of the second tubular rail. The preceding subject matter of this paragraph characterizes example 15 of the present disclosure, wherein example 15 also includes the subject matter according to example 14 above.

The handle, in certain examples, is configured to move the locking pin of the first support rod carriage simultaneously with the locking pin of the second support rod carriage between a first position that engages one of the plurality of positioning notches of each of the first tubular rail and the second tubular rail, respectively, and a second position that disengages the locking pin of the first support rod carriage and the locking pin of the second support rod carriage from one of the plurality of positioning notches of the first tubular rail and the second tubular rail, respectively. The preceding subject matter of this paragraph characterizes example 16 of the present disclosure, wherein example 16 also includes the subject matter according to example 15, above.

Additionally disclosed herein is an exercise machine. The exercise machine includes, in certain examples, an elongated frame having a head end and a foot end, and a moveable carriage slidably coupled to the elongated frame and moveable between the head end and the foot end, the moveable carriage having a spring bracket coupled to an underside of the moveable carriage. The exercise machines also includes a spring support rod slideably coupled with the elongated frame and disposed adjacent the foot end, and selectively positionable with reference to the foot end by a handle that extends from an interior area of the elongated frame to an exterior area of the elongated frame. The exercise machine also includes at least one resistive member coupled at a first end with the spring support rod and at a second end with the spring bracket, and configured to bias the moveable carriage towards the foot end of the elongated frame. The preceding subject matter of this paragraph characterizes example 17 of the present disclosure.

The exercise machine also includes, in certain examples, a pair of square-tube rails, each of the pair of square-tube rails coupled to an interior surface of the elongated frame and configured to support the moveable carriage. The preceding subject matter of this paragraph characterizes example 18 of the present disclosure, wherein example 18 also includes the subject matter according to example 17, above.

In certain examples, each of the pair of square-tube rails extends from the head end to the foot end and comprises an elongated opening disposed adjacent the foot end. The preceding subject matter of this paragraph characterizes example 19 of the present disclosure, wherein example 19 also includes the subject matter according to example 18, above.

The elongated opening, in certain examples, comprises a plurality of positioning notches. The preceding subject matter of this paragraph characterizes example 20 of the present disclosure, wherein example 20 also includes the subject matter according to example 18, above.

The described features, structures, advantages, and/or characteristics of the subject matter of the present disclosure may be combined in any suitable manner in one or more examples, including embodiments and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example, embodiment, or implementation. In other instances, additional features and advantages may be recognized in certain examples, embodiments, and/or implementations that may not be present in all examples, embodiments, or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings depict only typical examples of the subject matter, they are not therefore to be considered to be limiting of its scope. The subject matter will be described and explained with additional specificity and detail through the use of the drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
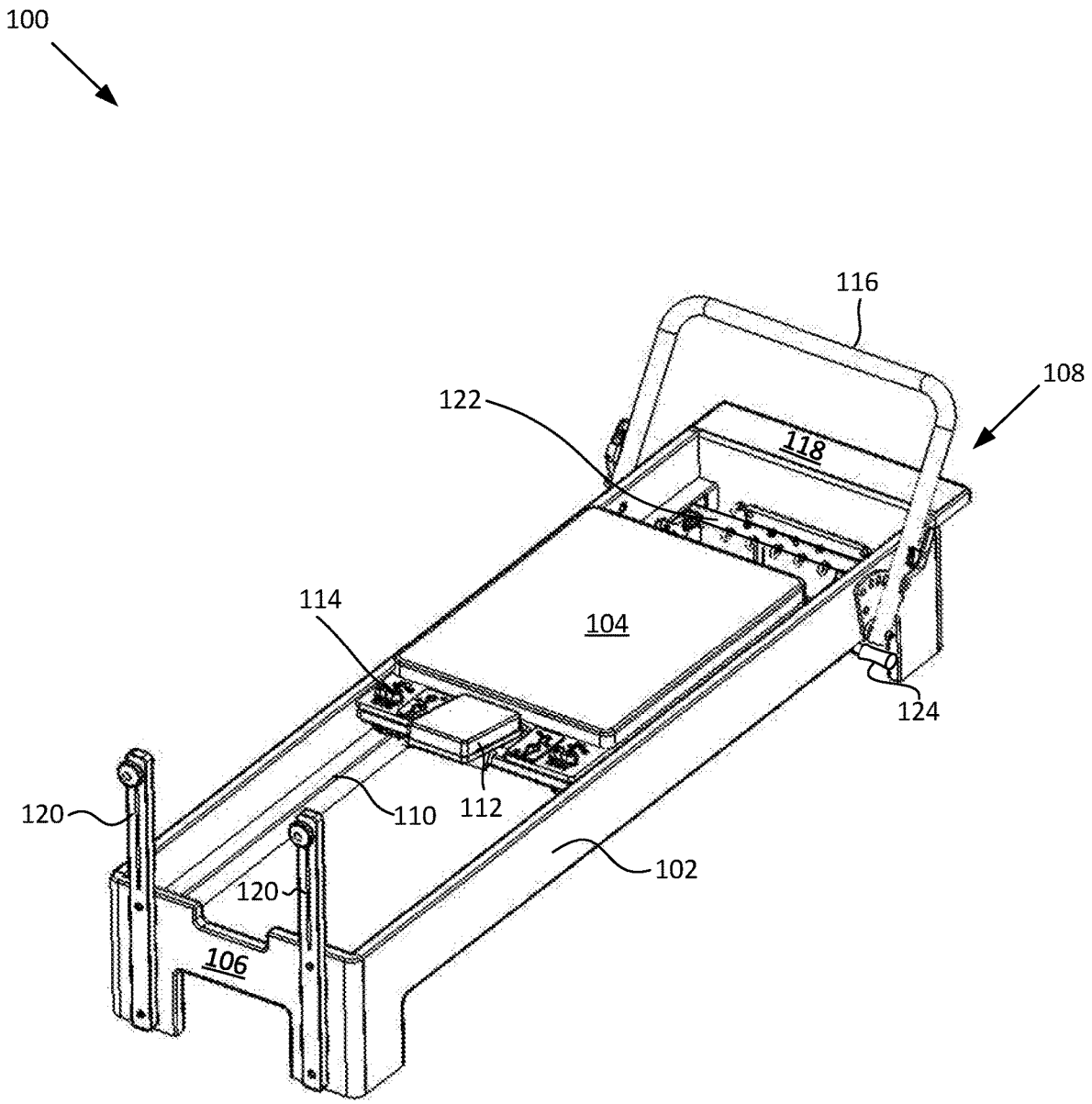
FIG. 1 is a perspective view diagram illustrating one example of a pilates reformer in accordance with examples of the present disclosure.

FIG. 1 is a perspective view diagram illustrating one example of a pilates reformer 100 in accordance with examples of the present disclosure. The pilates reformer 100, in certain examples, is formed with a rectangular frame 102. The rectangular frame 102 may be wooden, or alternatively, metal or a metal alloy. The rectangular frame 102, whether formed of wood or metal, is sturdy enough to support the weight of a user on a moveable carriage 104. The rectangular frame 102 is formed with a head end 106 and a foot end 108. The moveable carriage 104 moves longitudinally between the head end 106 and the foot end 108. Movement of the moveable carriage 104, in certain examples is biased, or resisted, by resistance devices. Examples of resistance devices include, but are not limited to, helical tension springs, elastic bands, etc.

In certain examples, the moveable carriage 104 rides on a pair of rails 110 that extend longitudinally along interior surfaces of the frame 102. The moveable carriage 104 may include wheel assemblies attached to a bottom surface of the moveable carriage which engage the rails and guide and maintain the position of the moveable carriage 104 within the frame 102 back and forth between the head end 106 and the foot end 108. As depicted, the moveable carriage 104, in certain examples, includes an adjustable headrest 112 and mounting brackets 114 for various accessories.

An adjustable foot bar assembly 116, in certain examples, is pivotally and removably fastened to the frame 102. The foot bar assembly 116 may pivot between a plurality of angular positions to provide a user a support against wish the user pushes to move the moveable carriage 104. The foot end 108 of the frame, in certain examples, also includes a foot platform 118 upon which the user may place a part of his/her body during the performance of different exercises.

The head end 106 of the frame 102, in certain examples, includes a pair of pulley arms 120. The pully arms 120 are mounted to either the interior surface or the exterior surface of the frame 102 and extend upward above a plane defined by the moveable carriage 104. The pulley arms 120 are configured to support pulleys (not shown) through which hand ropes may pass. The hand ropes, if attached at one end to the moveable carriage 104, enable a user to perform exercises that move the moveable carriage 104 against the resistance devices through the movement of the user's arms.

The resistance devices (not shown) attach at one end to the moveable carriage 104 and at a second end to a spring support rod 122. The resistance devices bias the moveable carriage 104 towards the foot end 108 of the frame 102. A user may increase or decrease the effort required to move the moveable carriage 104 by increasing or decreasing the number of resistance devices attached to the moveable carriage 104. The user may also change the type of spring and corresponding spring rates of the resistance devices to increase or decrease the effort required to move the moveable carriage 104. The spring support rod 122 is positionable within a support bracket (see FIG. 2) to adjust the position of the spring support rod 122 with reference to the foot end 108 of the frame 102. This beneficially allows for improved use by a wide variety of user body-types, and also different exercises. As will be described below in greater detail below, a handle 124 extends outward laterally (i.e., substantially perpendicular to a longitudinal axis of the frame) and enables a trainer to adjust the position of the spring support rod 122 within the support bracket.

Figure 2:
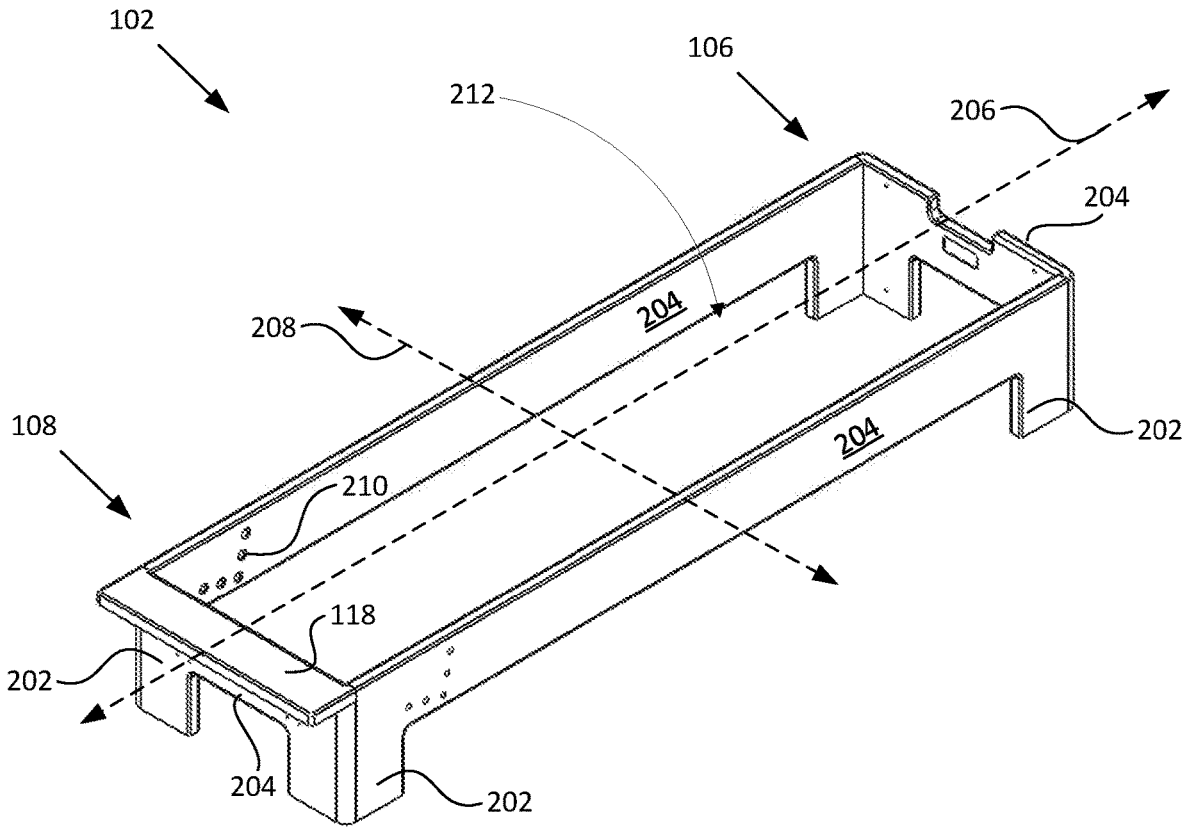
FIG. 2 is a perspective view diagram illustrating one example of the frame in accordance with examples of the present disclosure.

FIG. 2 is a perspective view diagram illustrating one example of the frame 102 in accordance with examples of the present disclosure. The depicted embodiment illustrates a substantially rectangular frame 102 formed out of, for example, wood. The frame 102, in certain examples, has four ground engaging legs 202 that space horizontal beams 204 of the frame 102 off of the floor a distance. This is helpful to form an opening that allows the handle 124 to extend outward past the frame 102. The foot end 108 of the frame 102 includes the horizontal foot platform 118. The foot platform 118, in certain embodiments, is planar and couples to a top edge of the frame 102. The foot platform 118 extends longitudinally away from the frame 102 in a substantially horizontal direction. As used herein, the term longitudinally refers to a direction along the longitudinal axis 206 of the frame 102. Correspondingly, the term laterally refers to a direction along the lateral axis 208 of the frame 102.

The frame 102, in certain examples, is formed with openings 210 for receiving fasteners. The fasteners are useful for coupling the rails 110 (see FIG. 1) to interior surfaces of the frame 102. Other components, including but not limited to, the foot bar assembly 116 and the pulley arms 120, are also coupled to the frame 102 with fasteners. The horizontal beams 204 form a cavity 212 which forms the "interior" of the frame 102.

Figure 3:
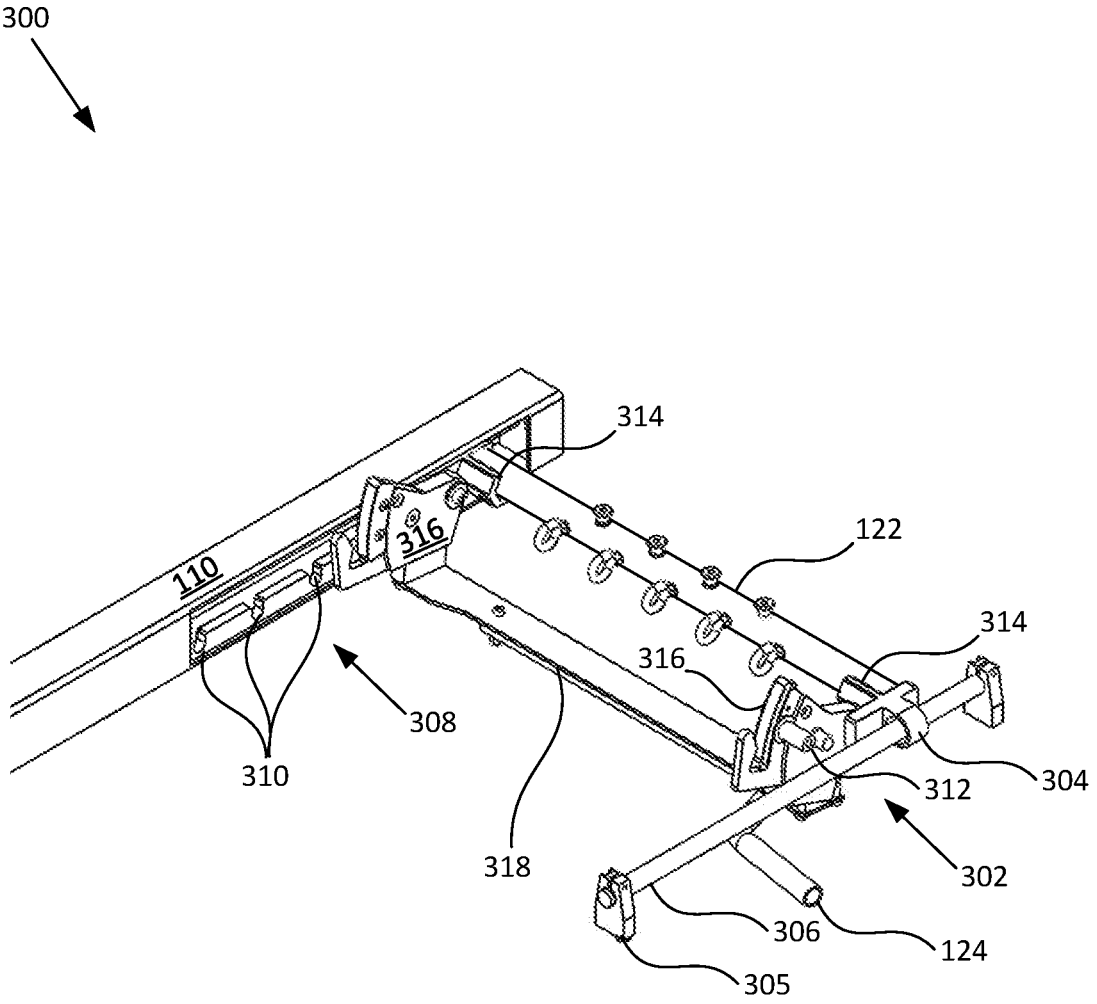
FIGS. 3-8 are perspective view diagrams illustrating examples of the spring support rod adjustment mechanism in accordance with examples of the present disclosure.
Figure 4:
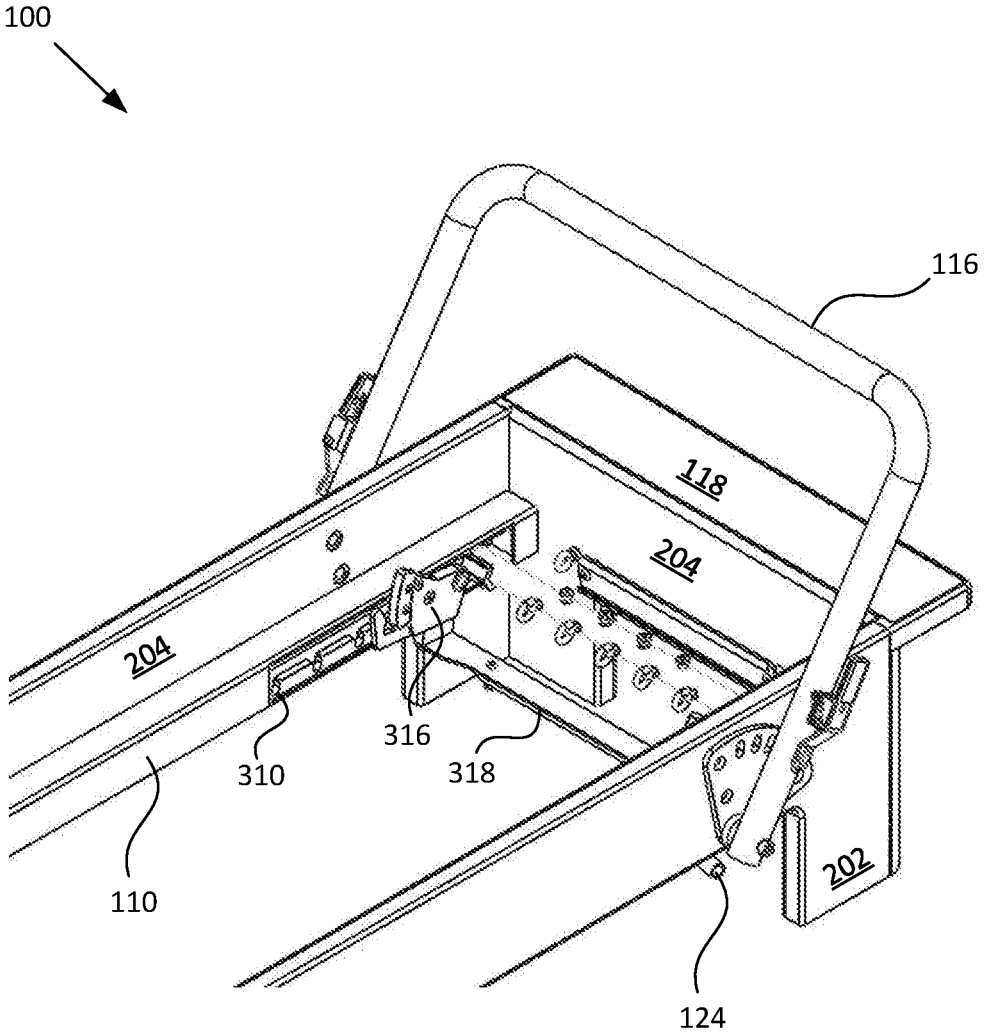
Figure 5:
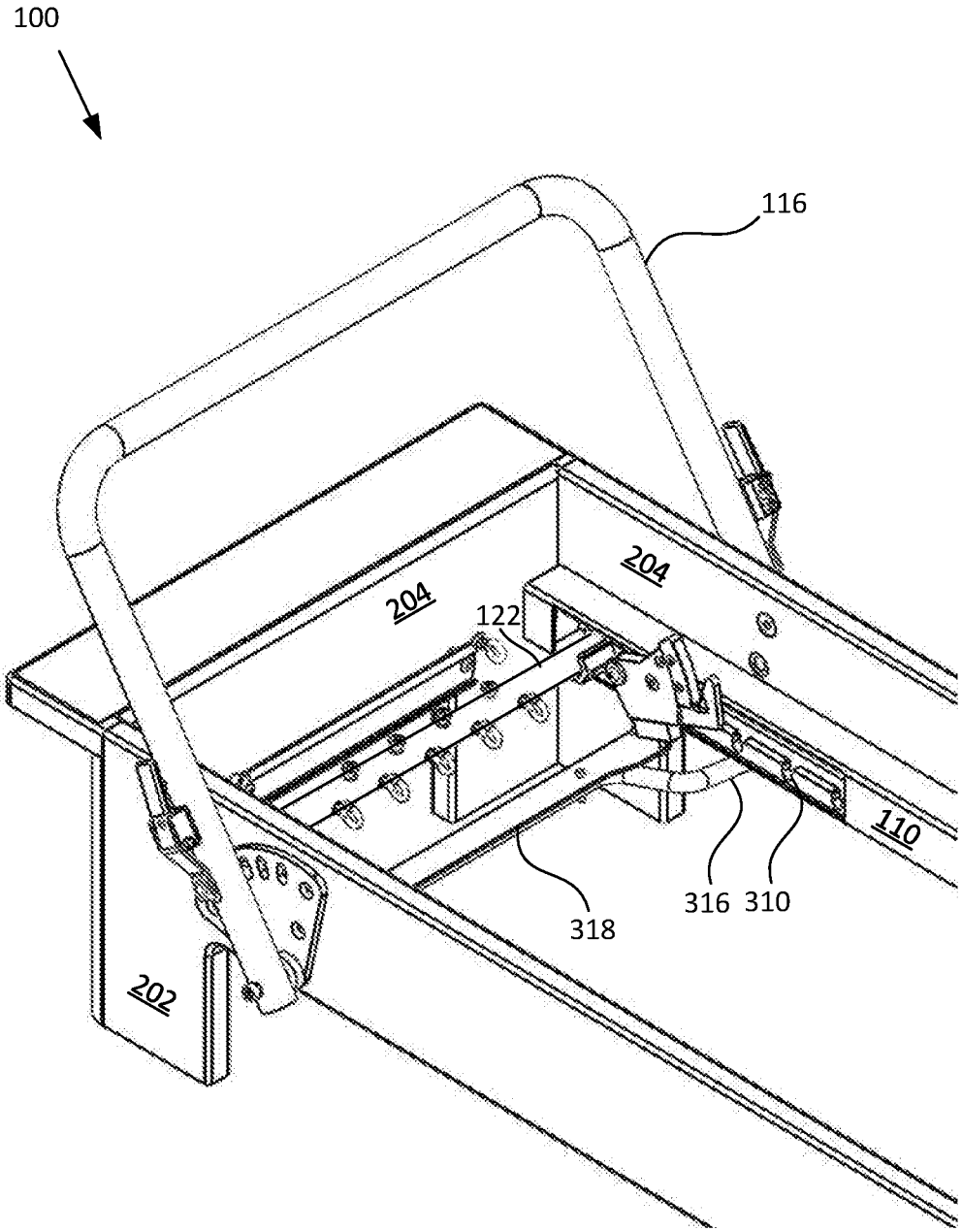
Figure 6:
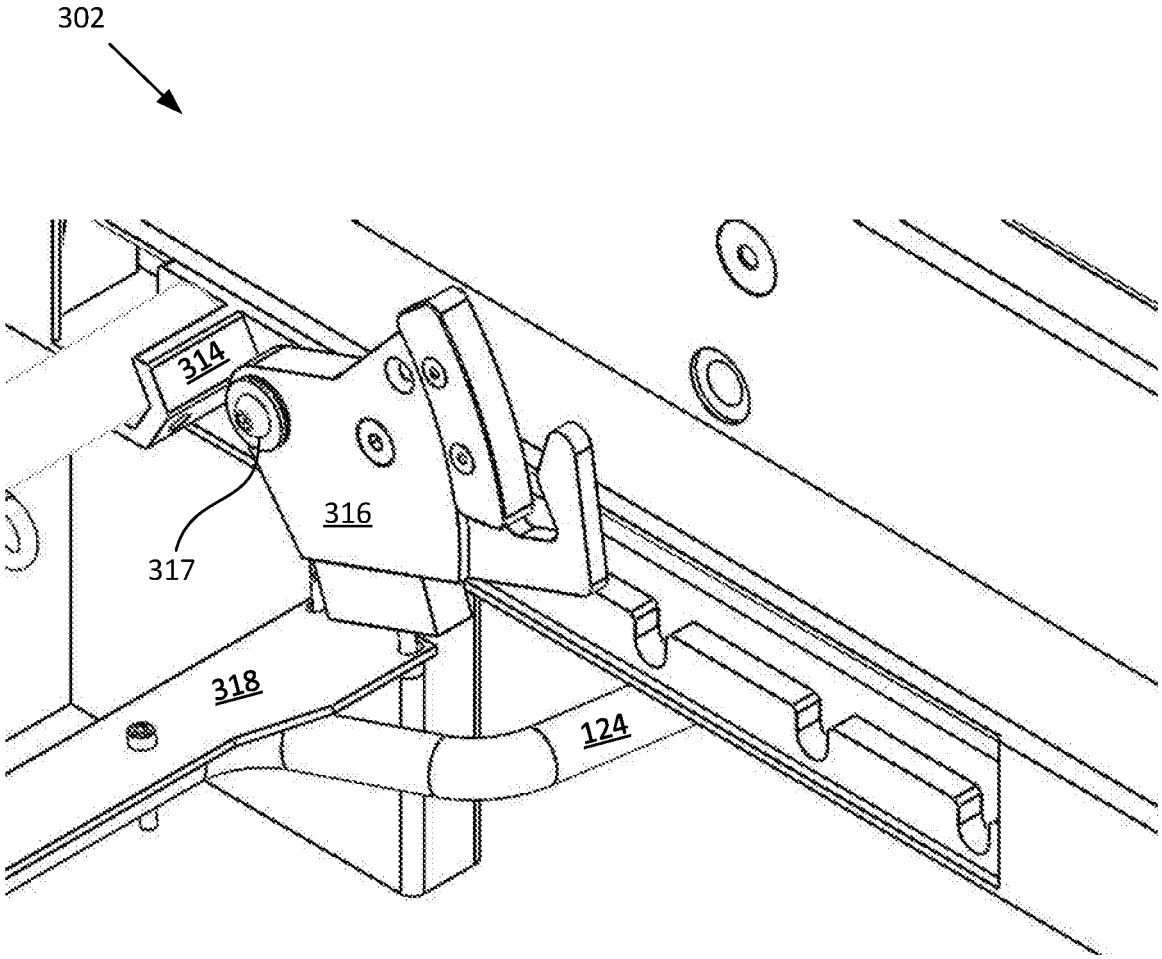
Figure 7:
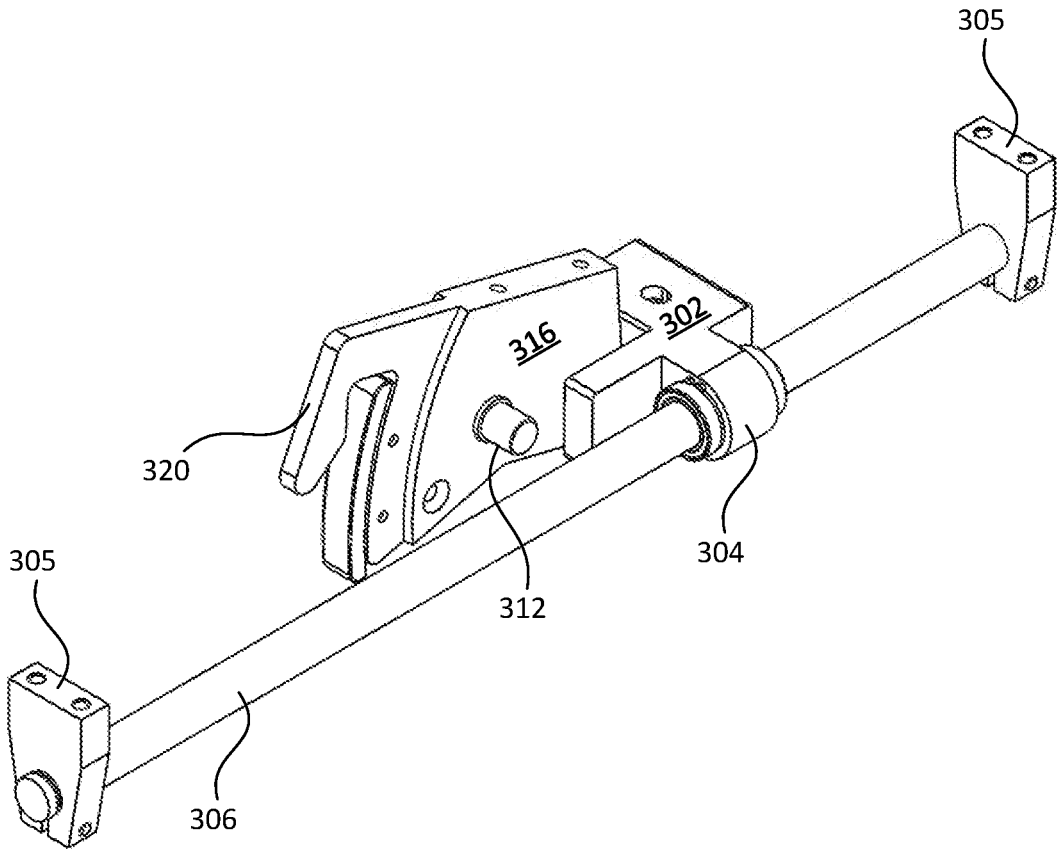
Figure 8:
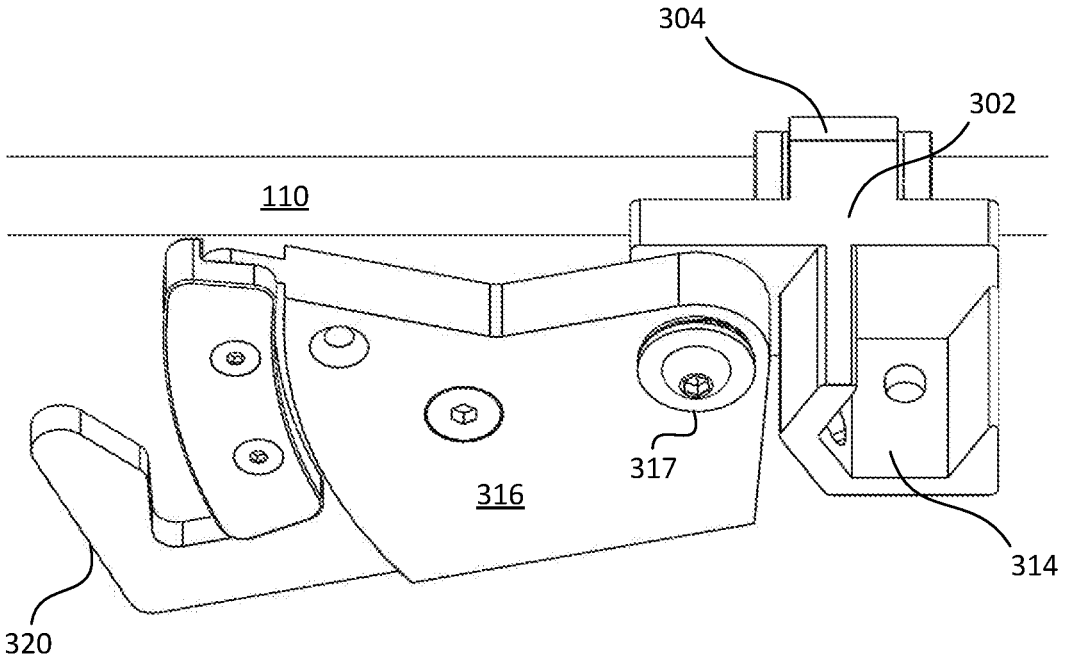

Referring now jointly to FIGS. 3-8, these figures are perspective view diagrams illustrating examples of the spring support rod adjustment mechanism in accordance with examples of the present disclosure. The different figures show different views, or in other words, the figures show/hide different components to better illustrate the configuration of the spring support rod adjustment mechanism 300. FIG. 3, in particular, hides the frame 102, foot bar assembly 116, and one of the rails 110.

The spring support rod adjustment mechanism 300 comprises a support rod carriage 302 having a ball bearing collar 304 that rides on a spring positioning rod 306. The spring positioning rod 306, in certain embodiments, is disposed within the rail 110 and extends coaxially within the rail 110 a distance that is suitable for adjusting the position of the spring support rod 122. Rod brackets 305 couple the spring positioning rod 306 to an interior surface of the rail 110. The rail 110, in certain embodiments, is an elongated square-tube with an opening 308 formed in a side surface of the rail 110. The opening 308 is disposed adjacent the foot end of the rail 110 and extends longitudinally towards the head end of the rail 110. Notches 310, in certain examples, are formed in the side surface of the rail 110 for receiving a locking pin 312 of the support rod carriage 302. The notches 310 create locking positions for the support rod adjustment mechanism 300.

The spring support rod 122 engages a rod socket 314 at each end of the spring support rod 122. Each support rod carriage 302 includes the rod socket 314 coupled to the ball bearing collar 304. Coupled to the rod socket 314 is a pivotable lock plate 316 to which the locking pin 312 is coupled. The pivotable lock plate 316 rotates around a pivot point 317 and is actuated by the handle 124. Stated differently, lifting the handle 124 upward causes the pivotable lock plate 316 to lift the locking pin 312 out of engagement with one of the notches 310 and enables longitudinal movement of the spring support rod adjustment mechanism 300 with respect to the rails 110. A handle plate 318 couples the pair of pivotable lock plates 316 so that a lifting force applied to the handle 124 causes both pivotable lock plates 316 to rotate upward and disengage both locking pins 312 from the notches 310.

In certain examples, the handle 124 is coupled to the handle plate 318 and extends outward laterally on an underside of the rails 110 past the frame 102 to be accessible from outside the frame 102. This beneficially allows a trainer to adjust the relative position of the spring support rod 122 with reference to the foot end 108 of the frame 102. Previously, any adjustments to the position of the spring support rod 122 were made within the cavity of the frame 102, and often required the trainer to have to reach between the legs of the user to make the adjustment.

The pivotable lock plate 316, in certain examples, is also formed with a bump stop 320 that is configured to engage the moveable carriage 104. In other words, while adjusting the position of the spring support rod adjustment mechanism 300, the bump stop 320 is configured to engage a substantially vertical, foot-end-facing surface of the moveable carriage 104.

Figure 9:
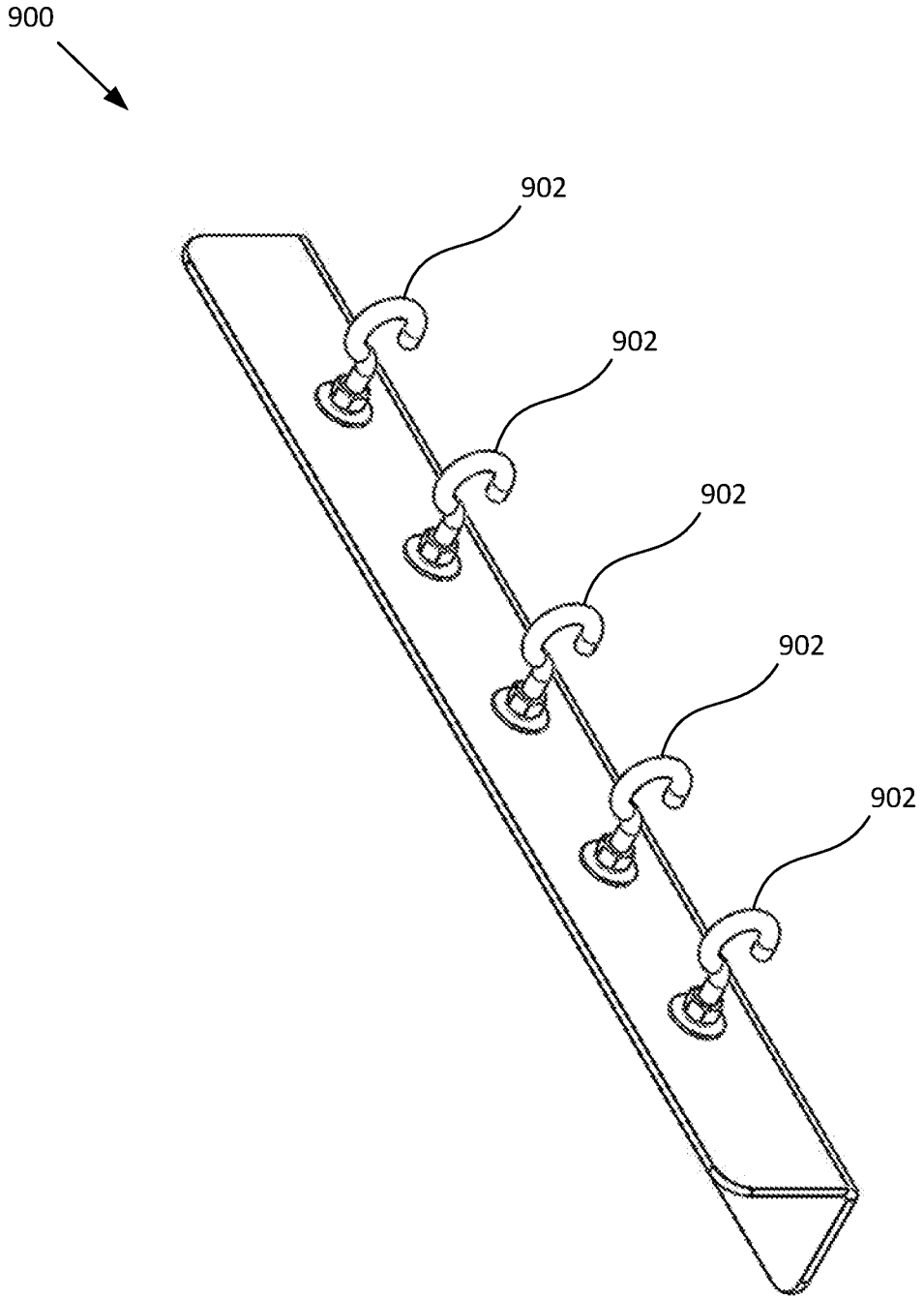
FIG. 9 is a perspective view diagram of a spring bracket 900 in accordance with examples of the present disclosure.

FIG. 9 is a perspective view diagram of a spring bracket 900 in accordance with examples of the present disclosure. The spring bracket 900, in certain examples, couples to an underside of the moveable carriage 104. The spring bracket 900 includes one or more hooks 902 for coupling to ends of springs or other biasing devices. The opposing ends of the springs or other biasing devices are coupled to hooks of the spring support rod 122. The spring bracket 900, in certain examples, is angle iron.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. An exercise machine comprising:

an elongated frame having a head end and a foot end;

a moveable carriage slidably coupled to the elongated frame and moveable between the head end and the foot end, the moveable carriage having a spring bracket coupled to an underside of the moveable carriage;

a spring support rod slidably coupled with the elongated frame and disposed adjacent the foot end of the elongated frame, and selectively positionable with reference to the foot end by a handle that extends to an area that is outside an area defined by the elongated frame;

at least one resistive member coupled at a first end with the spring support rod and at a second end with the spring bracket, and configured to bias the moveable carriage towards the foot end of the elongated frame; and a first spring positioning rod slidably coupled to and movable within a first rail on the elongated frame and a second spring positioning rod slidably coupled to and movable within a second rail on an opposing side of the elongated frame, wherein the spring support rod is coupled to and extends between the first and second spring positioning rods.

2. The exercise machine of claim 1, wherein the first rail is a tubular rail coupled to an interior surface of the elongated frame and configured to support the moveable carriage.

3. The exercise machine of claim 2, wherein the tubular rail extends from the head end to the foot end and comprises an elongated opening disposed adjacent the foot end.

4. The exercise machine of claim 3, wherein the elongated opening comprises a plurality of positioning notches.

5. The exercise machine of claim 4, wherein the spring support rod is coupled to a pivotable lock plate at each end, each of the pivotable lock plates having a locking pin extending therefrom configured to engage with one of the positioning notches of the plurality of positioning notches.

6. The exercise machine of claim 5, wherein the pivotable lock plates are coupled by a handle plate.

7. The exercise machine of claim 6, wherein the handle is configured to move the locking pin between a first position engaging a first one of the positioning notches and a second position engaging a second one of the positioning notches.

8. The exercise machine of claim 4, wherein the tubular rail is a square-tube rail.

9. The exercise machine of claim 1, where the spring support rod further comprises a plurality of hooks, where each of the plurality of hooks is configured to couple with a first end of the at least one resistive member.

10. The exercise machine of claim 9, wherein the spring bracket comprises a plurality of hooks, where each of the plurality of hooks is configured to couple with a second end of the at least one resistive member, and where the at least one resistive member biases the moveable carriage towards the foot end of the elongated frame.

11. The exercise machine of claim 1, wherein the spring support rod is coupled to a ball bearing collar at each end, each of the ball bearing collars configured to slideably couple with and move along one of the first spring positioning rod and the second spring positioning rod.

12. The exercise machine of claim 1, wherein the movable carriage is slidably coupled to the frame by wheel assemblies attached to the underside of the movable carriage.

13. The exercise machine of claim 1, wherein the movable carriage further comprises an adjustable headrest.

14. The exercise machine of claim 1, wherein the movable carriage further comprises a plurality of mounting brackets for at least one accessory.

15. The exercise machine of claim 1, wherein the at least one resistive member is one of a helical tension spring, an elastic bands, or a combination thereof.

16. An exercise machine comprising:

an elongated frame having a head end and a foot end;

a moveable carriage slidably coupled to the elongated frame and moveable between the head end and the foot end, the moveable carriage having a spring bracket coupled to an underside of the moveable carriage;

a spring support rod slidably coupled with the elongated frame and disposed adjacent the foot end of the elongated frame, and selectively positionable with reference to the foot end by a handle that extends to an area that is outside an area defined by the elongated frame; and at least one resistive member coupled at a first end with the spring support rod and at a second end with the spring bracket, and configured to bias the moveable carriage towards the foot end of the elongated frame, wherein the spring support rod is coupled to a pivotable lock plate at each end, each of the pivotable lock plates having a locking pin extending therefrom configured to engage with a positioning notch, and wherein the pivotable locking plates are coupled by a handle plate.

17. The exercise machine of claim 16, wherein the handle is configured to move the locking pin between a first position engaging a first one of a plurality of positioning notches and a second position engaging a second one of the plurality of positioning notches.

18. The exercise machine of claim 16, wherein the movable carriage is slidably coupled to the frame by wheel assemblies attached to the underside of the movable carriage.

19. The exercise machine of claim 16, wherein the movable carriage further comprises an adjustable headrest.

20. The exercise machine of claim 16, wherein the movable carriage further comprises a plurality of mounting brackets for at least one accessory.

* * * * *